United States Patent [19]

Tarantola

[11] 4,335,571

[45] Jun. 22, 1982

[54] APPARATUS FOR CABLING WIRES

[75] Inventor: Luciano Tarantola, Milan, Italy

[73] Assignee: Industrie Pirelli S.p.A., Milan, Italy

[21] Appl. No.: 26,550

[22] Filed: Apr. 3, 1979

[30] Foreign Application Priority Data

May 9, 1978 [IT] Italy ..... 23149 A/78

[51] Int. Cl.[3] ..... D07B 3/12; D07B 3/02

[52] U.S. Cl. ..... 57/58.52; 57/58.83; 57/311

[58] Field of Search ..... 57/58.32, 58.52, 58.54, 57/58.55, 58.7, 58.83, 9, 311

[56] References Cited

U.S. PATENT DOCUMENTS

| | | | |
|---|---|---|---|
| 2,910,823 | 11/1959 | Bunch | 57/58.52 |
| 3,431,718 | 3/1969 | Hofrichter | 57/58.52 X |
| 3,585,792 | 6/1971 | Hofrichter | 57/58.52 |
| 3,774,385 | 11/1973 | Maderna | 57/58.52 |
| 3,791,127 | 2/1974 | Wesson | 57/58.52 |
| 3,791,131 | 2/1974 | Scott et al. | 57/58.52 X |
| 3,824,775 | 7/1974 | Birch | 57/58.52 |
| 3,867,809 | 2/1975 | Holbrook | 57/58.52 |
| 4,141,205 | 2/1979 | Berges et al. | 57/58.55 X |

*Primary Examiner*—John Petrakes

*Attorney, Agent, or Firm*—Stevens, Davis, Miller & Mosher

[57] ABSTRACT

An apparatus for cabling wires into a predetermined stranded configuration has at least one first pay-off bobbin rotatably supported inside a carrier, in its turn freely rotating inside a cage-type device and coaxial with it.

The cage is supported to rotate about its own axis.

Part of the wires constituting the produced cord can be drawn through the apparatus coming from a second, external to the apparatus, pay-off bobbin.

The carrier comprises means for guiding the wires along a path developed from one extremity and/or from the first pay-off bobbins to the other extremity of said carrier, said path being not coincident with the axis of the apparatus, and means, disposed along said path, for permanently deforming the wires by bending.

5 Claims, 3 Drawing Figures

APPARATUS FOR CABLING WIRES

The present invention relates to an apparatus for rapidly and economically manufacturing metallic cords such as steel cords widely used in the rubber industry as reinforcing elements for various products such as, for example, vehicle tires, power transmission belts, conveyor belts and the like. This invention also relates to the metallic cords thus produced.

The apparatus provided by the invention is adapted for making such reinforcing cords either with or without a core. The latter cords are of two diverse types depending upon whether the elements constituting the cords are even or odd in number as shall be further explained later on herein.

For a better understanding of this disclosure and for more precisely clarifying the terms that are used herein, it is expedient to recall to mind certain basic facts regarding metallic cords of the type contemplated herein.

To begin with, the basic elements of the cord referred to as "elementary wire", i.e., the very thin steel wire, have a prefixed diameter that is generally variable between 0.12 mm and 0.38 mm for cords used in rubber technology. It is known that a metallic cord is made up of a plurality of such "elementary wires" stranded together according to various geometrical configurations which are rendered stable by means of appropriate permanent deformations created in the "elementary wires".

This permanent deformation, which is for maintaining firmly the strands of the wires, can be of two types; namely, either with deformation by bending only, which can be developed both in the direction parallel to the wire axis, i.e., according to a generatrix of the wire itself, as well as according to a trajectory which has a cylindrical helix on the surface of the wire; or else, a mixed deformation, i.e., simultaneously torsional and bending, that finally have the same effect as the previous bending alone, with a helical development.

It is clear that a deformation which is exclusively torsional could not be of any use in stranding together various metallic wires.

The cord constituted by a plurality of elementary wires that are wound together is thus referred to herein as a "strand". It is known that metallic cords may be either of a single strand, or of several strands that are wound together according to various geometrical variations.

In the description that follows, whenever reference is made to a wire, unless the contrary is expressly specified, either "elementary wires" or strands are intended.

The cords constituted by a certain number of wires that are all wound at the same pitch without a core wire are referred to herein as a "cord without core". Each wire occupies successively and periodically in the cord, all the positions in a given section that are contemporaneously occupied by other wires, and alternate with those wires.

These cords are usually indicated by an expression such as of the type namely: $a \times b \times c$, whereby a indicates the number of strands; b indicates the number of elementary wires in each strand; and c indicates the diameter of the elementary wires.

Cetain examples of these cords are the $1 \times 5 \times 0.20$; $1 \times 7 \times 0.18$; $7 \times 3 \times 0.18$.

The "with core" cords include, on the other hand, a straight central wire and several wires cabled thereabout which constitute the so-called layer.

These cords may be identified in their more generalized form by the expression: $a \times b \times c + d \times e \times f$, wherein a and b indicate the number of strands a and the elementary wires b that are in each strand for the core; whereas d and e indicate the same parameters for the layer; and c and f indicate the diameters of the elementary wires.

Examples of these cords are the $1 \times 3 \times 0.15 + 5 \times 7 \times 0.15$; or the type $1 \times 3 \times 0.15 + 6 \times 1 \times 0.27$.

The latter cord is better known internationally as "six-over-three", and it comprises a core having a strand of three elementary wires wound together, and a layer of six elementary wires helically wound around the central strand.

The "six-over-three" cord is widely used in the rubber industry which is interested in achieving high quality characteristics at low production costs. These characteristics can be obtained advantageously by means of the apparatus of this invention.

An object of this invention is to provide an apparatus of the universal type, i.e., employable for constructing cords either "with" or "without" a core regardless of the number of wires in the cord. Another object of the invention is to provide such an apparatus of relatively small dimensions compared to the prior art apparatus but at least equal in performance to the larger apparatus.

The objects of the invention are achieved in accordance with the invention by varying the method of constructing cords depending upon whether an even or odd number of wires are used, providing in the instance of cords with an odd number of wires, a new type of metallic cord.

Hence, what forms the object of the present invention is an apparatus for cabling metallic cords, and in particular cords for specific uses such as the reinforcing elements of an elastomeric structure, the elements comprising the said cords, and which are generically defined as wires, can be either elementary wires, i.e., single metallic wires, or strands, i.e., distinct groups of elementary wires previously coiled together, or even a combination of elementary wires and strands, the cords resulting from the union of the wires according to a prefixed geometrical configuration obtained and maintained through the means of appropriate permanent deformations, due to bending and torsion subjected to the wires. The apparatus comprises a carrier or similar supporting device for one or more pay-off bobbins for at least part of the wires. The bobbins are fully mounted to rotate in the carrier. Each bobbin rotates around its own axis. The apparatus also has (a) a device, defined as a cage, adapted for guiding the said wires along a prefixed trajectory, (b) a structure, adapted for supporting the cage while permitting it to rotate around its own axis, (c) means for maintaining the cage in rotation, (d) means adapted for unwinding the wires from their respective pay-off bobbins and for drawing them through the stranding machine in an advancing direction, and (e) means adapted for collecting the cords produced. The carrier is mounted between the cage, coaxially with the cage, and freely rotating with respect to it, the shuttle and the cage being adapted for permitting their terminal ends to be traversed by the wires, along a trajectory that coincides with their own axis, the apparatus being characterized by the fact that the shuttle comprises means adapted for guiding the wires according to a trajectory developed from one carrier extremity to the other, and coincident with the axis of the carrier at said extremity, but spaced from said axis within the region between said extremities, and means adapted for conferring the said permanent bending deformations and at least part of said permanent torsional deformations (twisting and untwisting) which are adapted for producing said cords according to a fixed and permanent geometrical configuration.

According to a particularly suitable embodiment of the invention, the means that are adapted for conferring the permanent bending deformations develop these deformations on the wires along a direction that is parallel to the direction of advancement. These means are, in particular, constituted by a pre-shaping pin mounted on the shuttle with its axis orthogonal to the direction of advancement of the wires.

As regards the means adapted for guiding the wires along the trajectory developed from one extremity to the other within the cage, first and foremost, these means comprise two rollers disposed along the trajectory of the wires at the opposite side with respect to the pre-shaping pin, and disposed in such a way, that the trajectory which directly joins the rollers does not present any point of interference with the pre-shaping pin, but, in particular, is tangential to the rotary surface of the pin.

Before coming to the pin, naturally in the advancing direction of the wires, there is situated a roller adapted for receiving the wires, coming from a direction diverse, and for disposing these wires parallel, coplanar and side-by side to each other, and for guiding the wires thus disposed, onto a device adapted for permanently deforming them.

Finally, the said means comprise two other rollers, disposed with their rotary surface substantially tangent to the carrier axis, and disposed respectively at the start and at the finish of the trajectory of the said wires that traverse the carrier, and being distinct from the said carrier axis, each roller being coupled with a corresponding roller (found immediately adjacent and outside the carrier) and mounted on the cage with its rotary surface substantially tangential to the cage axis), said coupled rollers being adapted for conferring upon the wires a permanent torsional deformation, by means of the said cage rotating with respect to the carrier.

The present invention will be still better understood from the following description, together with the attached drawings, given solely by way of nonlimiting examples, wherein.

Figure 1:
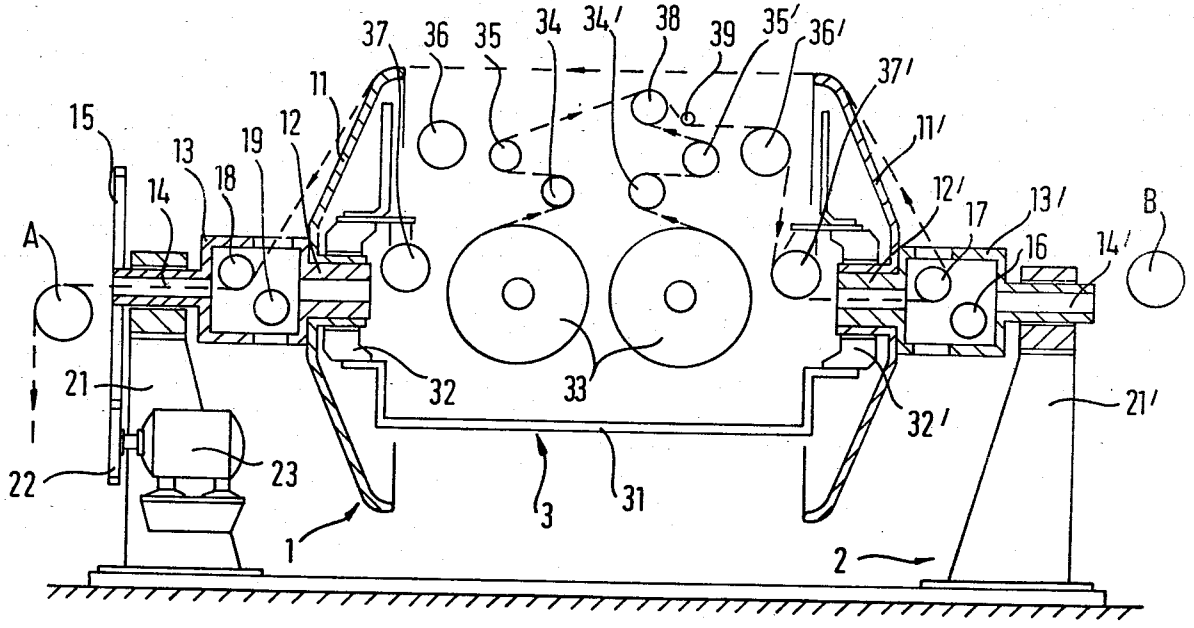
FIG. 1 illustrates an apparatus according to the invention for cabling a metallic "without core" cord having an even number of wires.

With reference to FIG. 1, the apparatus comprises essentially a cage 1 supported by a base 2, fixed to the ground in such a way as to permit the rotation of cage 1 around its own axis which is horizontally disposed, and by a bobbin-carrier 3, mounted coaxially inside the cage and rotating freely with respect to it.

For the further detailed description of the apparatus, two-figure reference numerals will be used. The first of these figures is for indicating the element (from amongst those just cited) to which the detail refers. It is clear, therefore, that these numerical references used do not permit being progressively arranged in a complete series as some references are lacking. This fact, however, does not result in being prejudicial to the invention, or to its clear definition.

The cage 1 has two discs 11 and 11' coaxially disposed and spaced but being fast with each other; each disc being provided with an axially hollow hub 12 made fast with a frame 13 (disposed axially outside with respect to the cage) which, in its turn, is made fast with a sleeve 14 which is also hollow, and coaxial with hub 12.

Each sleeve is mounted onto a corresponding support 21 of the base 2, through "known" means, i.e., the usual roller-bearings or ball-bearings, or any other type that permits the free rotation of the sleeve.

The sleeve 14 (shown to the left of the Figure), is attached to and coaxial with a cog-wheel 15 that engages with a corresponding cog-wheel 22 connected to an activating motor 23 fixed to the base.

The two frames 13' and 13 each support the rotary axes, horizontally and perpendicularly to the cage axis, respectively of the pairs of freely rotating return-rollers 16 and 17, 18 and 19.

The hubs 12 and 12' project in cantilever fashion, inside the cage, and serve as a support for the carrier 3. More particularly, shuttle 3 is constituted by a framework 31 (not detailed in the Figure in order not to complicate the drawing) that is made fast with the two bushings 32 and 32' mounted co-axially, and freely rotating on the hubs 12 and 12' respectively.

The framework 31 supports the axes (all horizontal with respect to the ground, and in a perpendicular direction with respect to the cage axis), of the pay-off bobbins 33, the return-rollers 34, 35, 36, 37 and 34', 35', 36', 37', the roller 38, and the pre-shaping pin 39.

Both bobbins, as well as the rollers indicated, rotate freely around their own axis. Moreover, it is understood that the bobbins for paying-off wire are provided with conventional braking devices (not shown). The braking devices intervene during the steps for decelerating the unwinding rate of the wire according to operating steps that are already "known" to technicians in the field.

In FIG. 1, only two bobbins for paying-off the wire, are indicated. However, these bobbins can be more in number, and they can in particular, be symmetrically disposed both with respect to the axial horizontal plane, as well as with respect to the axial vertical plane.

As far as concerns the return-rollers, it is to be noted that all these rollers 16 and 17, 18 and 19, as well as rollers 37 and 37' are mounted onto their respective supporting structures in such a way that their rotary surfaces are tangential to the axis that is common to the cage and the carrier.

As for rollers 36 and 36', these are mounted onto the carrier in such a way that the tangent common to their rotary surfaces, representing the trajectory of a wire passing directly from one roller to the other, but connecting with the effective trajectory of the wires on the said rollers, does not have any point of interference with the pre-shaping pin 39, but is only, at most, tangent to it.

The machine is moreover served by a conventional device for collecting the manufactured cords (not illustrated) placed downstream of the roller A, with respect to the advancing direction of the cord, indicated by an arrow placed along the trajectory line representing figuratively and according to its position, the wires, or the assembled cords.

The collecting device exerts tractional forces upon the wires, which forces are necessary for unwinding them from their respective paying-off bobbins and for drawing the wires through the stranding machine, in a "per se known" way.

What is more, the machine is correlated to a supporting device (also not illustrated) for supporting an additional paying-off bobbin situated outside the machine and disposed upstream of the roller B (still with respect to the advancing direction of the wires). The bobbin feeds the stranding machine (as the case may be, and as shall be duly explained later), either with another component wire, for the stranded type of cords; or else with the core for the corresponding type of cords.

To end with, it is pointed out immediately that, when the machine is operating, the cage is kept rotating around its own axis by means for motor 23, and hence, along with the said rotary cage, the axes also rotate, brought about obviously, by the action of appropriate pivots, of the rollers 16 and 17, 18 and 19, while the carrier 3, being idly mounted, i.e., freely rotating on the hubs 12 and 12', does not rotate owing also to the effect of the considerable weight of the system itself, the barycenter of which lies in a lower position with respect to the center of suspension. In this way the carrier, at the very most, merely oscillates around its own axis during the transitory phases of starting-up and/or turning-off the machine.

Hence, besides the carrier, there also remain stationary the axes of the bobbins 33 and all the other rollers mounted thereon.

Now that the machine has been described, one can proceed to explain its actual function.

In FIG. 1, the machine is shown making a metallic cord of the a×b×c type, i.e., a single strand of the without-central-core type. It can be also supposed, in particular, that this is the cord 1×4×0.22, i.e., a single strand of four elementary wires wound together each having a diameter of 0.22 mm.

The above-said four wires are wound onto the bobbins 33, for example, two wires per each bobbin, or else one wire per each bobbin—the bobbins, in this case being four in number and symmetrically disposed with respect to the axial vertical plane of the machine.

These elementary wires are unwound from their bobbins, and taken to the pre-shaping pin 39 by means of the series of return-rollers (illustrated), whereupon they are all subjected to the identical permanent bending deformation, along a line that is parallel to their axis, and namely, along one of their generatrixes.

From the pre-shaping pin, the elementary wires are then taken to the rollers 36' and 37'; and from there, by means of the perforated hub 12', they pass onto the roller 17, on which they are wound, with a variation in the advancing direction, for being conducted in the direction opposite, gliding over disc 11', along the external surface of the cage, and thence onto disc 11, and around the rollers 18 and A, at the collecting device.

It must now be noted that the wires will all arrive parallel to each other, firstly on roller 37' that has a fixed axis, then on roller 17 the axis of which, on the other hand, rotates along with the frame 13' around the cage axis.

It is therefore clear that, in the space between rollers 37' and 17, the wires are subjected to a first torsion having the effect of stranding the wires together. The stranding operation is easily and regularly realized, thanks to the permanent bending deformation that preliminarily takes place on the pre-shaping pin 39.

Hence, from roller 17, it is an already-formed cord that is drawn away and no longer the group of four distinct wires coming from roller 37. Moreover, it can easily be verified that, before actually being wound, the said cord undergoes a further torsion in the same direction as the first, upon passing from roller 18 (having a rotary axis) to roller A (having a fixed axis).

If the cord is of the more complex type, for example: 4×7×0.18, the process just described, still results. Naturally, in such an instance, onto the pay-off bobbin there must previously have been wound, not the elementary wires, but the four strands constituting the cord, i.e., the formations 1×7×0.18.

Figure 2:
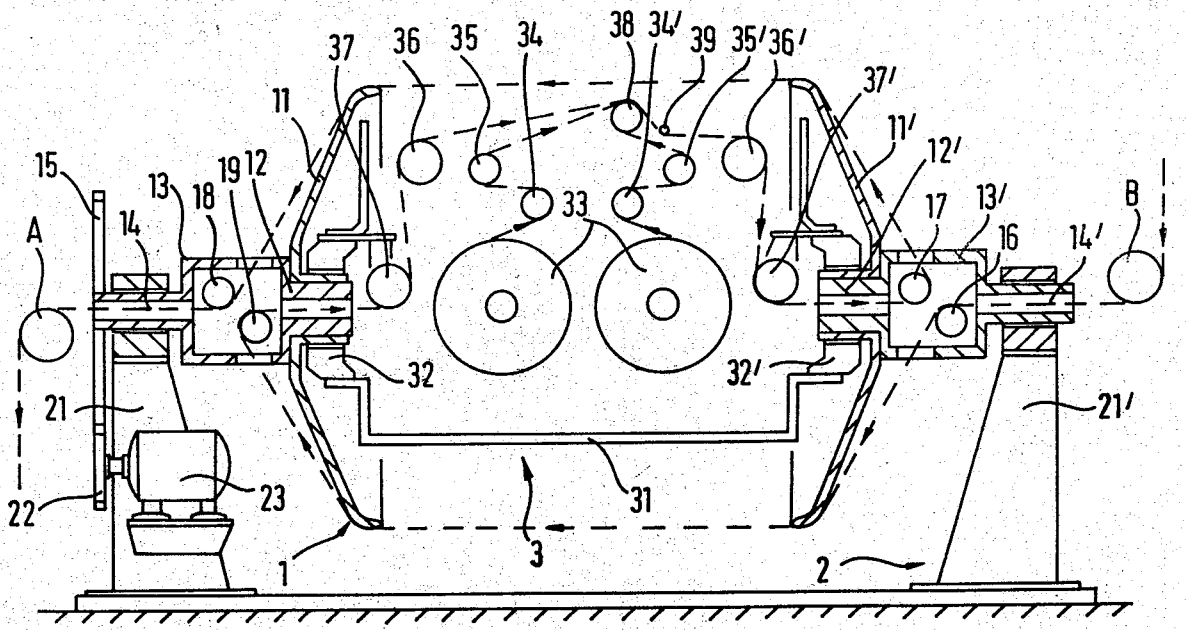
FIG. 2 illustrates the apparatus of FIG. 1 for making a "without-core" cord with an odd number of wires.

Before passing on to FIG. 2 and to the description of the method for forming the corresponding cords with an odd number of wires, it becomes expedient at this point to put forward certain considerations in advance.

It is quite clear that, for obtaining the maximum volumetric filling of the machine, i.e., the filling of the cylindrical volume of the cage, and hence for having a machine with smaller dimensions but having a high productivity, the pay-off bobbins that are mounted on the carrier must be disposed symmetrically with respect to the two orthogonal-to-each-other planes, the horizontal and the vertical.

This would require an "even" number of pay-off bobbins. Consequently, if it should be desired to form a cord from an "odd" number of wires, such as for example a cord 1×5×0.25 wherein the component wires are five (elementary wires), the entire possibilities of the machine itself could never reasonably be taken full advantage of due to the fact of having to allow one bobbin's place to go free, in a machine that was actually provided with a greater capacity than what was required of it in practice, and consequently also resulting in an unequal balance of weight.

According to the present invention, in such a case one of the wires comprising the cord is no longer fed from the inside, but from the outside of the machine, providing thus quite a diverse method for forming cords, and, at the same time, a new type of cord, as will now be described in connection with FIG. 2.

Suppose, for simplicity's sake, that the above-said 1×5×0.25 cord is to be constructed. Four wires (of the five wires comprising the cord) are mounted onto bobbins 33 as in the previous case, and one wire is mounted onto a bobbin (not illustrated) that is placed upstream of B.

The fifth wire, paid-off from said bobbin, passes into the sleeve 14' and from thence, by means of the roller 16, it is taken (via an opening in the frame 13') to the outside of the cage 1 and along the latter to its opposite extremity, where it passes onto the roller 19, via an opening in the frame 13 and then enters into the hollow hub 12 for entering into the cage on the return-roller 37 and from there onto roller 36 and thence onto roller 38.

During the above-said path, this wire evidently undergoes a first torsion, between the rollers B and 16, and a second torsion, in the identical direction as the first, between the rollers 19 and 37, as can easily be comprehended on observing that the rollers B and 37 have their axes fixed, whereas the rollers 16 and 19 have their axes rotary.

Finally, the twisted wire arrives at roller 38, where it unites with the other remaining four wires issuing from bobbins 33, to then pass together with these wires onto the pre-shaping pin 39.

It is quite clear, therefore, that, owing to the preliminary torsion, the permanent bending deformation, according to a line parallel to the advancing direction of the wire, that takes place on the pre-shaping pin, will result as having been developed according to a cylindrical helix with respect to a wire in an untwisted state.

From the pre-shaping pin 39, the five wires follow the already described path, before undergoing the aforesaid torsions between the pairs of rollers 37' and 17 and rollers 18 and A and twisting helically between them, in such a way as to produce the required cord.

However, it must be noted that, whereas for the four wires issuing from bobbins 33, the last two torsions mentioned are actual torsions which bring about the necessary cording, for the fifth wire issuing from the bobbin placed outside (that is, preliminarily twisted between the rollers B and 16 and 19 and 37), said subsequent torsions are, in reality, certain de-torsions that return the wire to its untwisted state—thus leaving it permanently deformed by bending only, said bending deformation being however, (as already stated) developed according to a cylindrical helix, and hence, capable of regularly stranding the fifth wire together with the other four wires.

It is quite clear that the thus obtained cords will obviously present all their wires shaped helically. But a conformation such as this will be effectuated in a single wire by means of a bending deformation only—which is developed however, according to a cylindrical helix along the axis of the wire itself; and in the remaining wires, through the simultaneous permanent torsional as well as bending deformations—the latter being developed along a line that is parallel to the wire axis, namely, along a generatrix of the wire itself.

Figure 3:
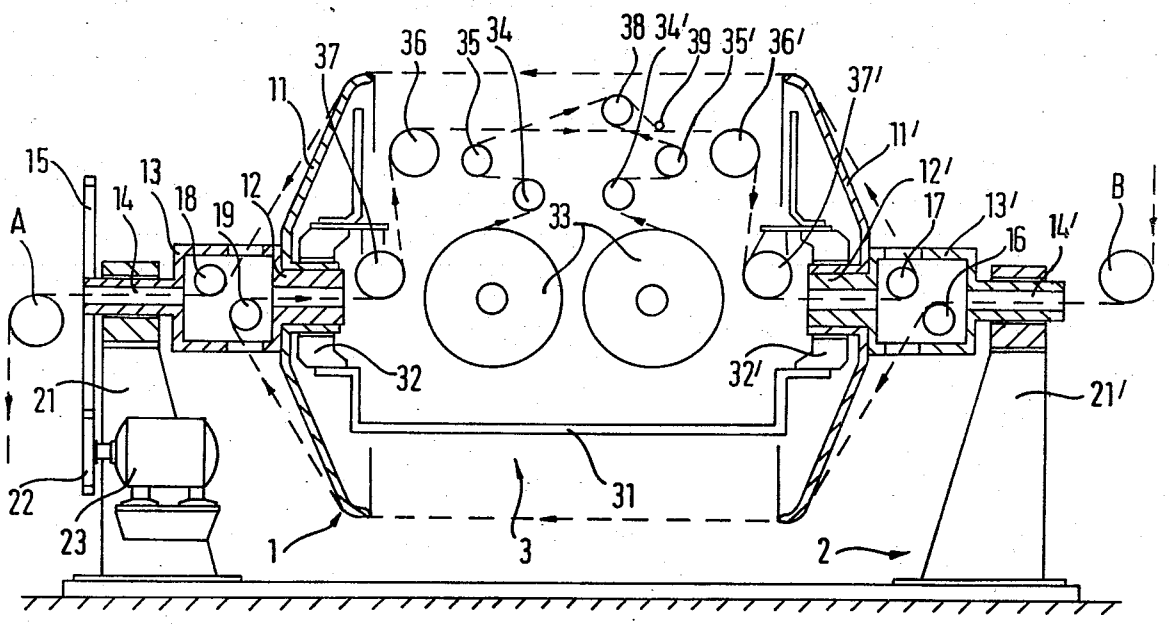
FIG. 3 illustrates the apparatus of FIG. 1 adapted to make a "with-core" cord.

On the basis of the description already given, the arrangement for constructing the "with-core" cords as illustrated in FIG. 3 can be easily understood.

Let it be supposed, for example, that one wishes to produce the above said "six over three" cord.

From the pay-off bobbin outside the machine, there is issued hence the core for the cord, i.e., the already formed $1\times3$ strand.

The bobbins 33 are, on the contrary, inside the shuttle where they are mounted for paying-off the layer wires.

The core, as already observed for other wires, passes over the roller B and into the sleeve 14', and from there, by means of roller 16, it is taken outside the cage 1 from which it passes onto roller 19. From there, it passes through the hub 12 and onto the roller 37 and thence onto roller 36.

From this roller 36, the core now passes directly onto roller 36' without being wound onto the pre-shaping pin 39, (said core being, at the very most, tangent to it). Hence, the core passes on without undergoing any pre-shaping, i.e., the corresponding permanent bending deformation.

In the space lying between the pre-shaping pin 39 and the roller 36', the said core joins up with the six layer wires which, on the contrary, come from the pre-shaping pin, and together with these wires, it follows the path already described.

As the said core has not been flexurally deformed but only torsionally so (between the rollers B and 16 and rollers 19 and 37), the core is, as a consequence, unable to wind helically together with the layer wires. Hence, it remains rectilineal while said layer wires wind helically around (owing to the torsional effects undergone between the rollers 37' and 17 and rollers 18 and A).

It is clear, therefore, as was already explained, that the last-stated two torsions have the effect of completely unwinding the core which hence arrives as a result in an undeformed state at the exit of the roller A, i.e., in the finished cord, and in spite of the twisting that it has undergone during its passage through the stranding machine.

It is therefore apparent how the machine illustrated and described provides a very advantageous solution of the problem of cording for any sort of metallic cords.

In comparison to prior art machines, the apparatus of the present invention proves itself to be extremely versatile in providing for the construction of cords either with or without a central core. Moreover, it has a productive capacity which is, at the very least, equal to that of any of the various up-to-date machines heretofore employed in the construction of diverse types of cords.

What is even more important, thanks to the high coefficient of volumetrical exploitation, the machine presents moreover less cumbersome dimensions (when compared to any other "known" machines offering a generally similar performance), and also a greater productivity—which fact alone, allows for a considerable economic advantage.

Downstream of roller A and upstream of roller B, instead of directly installing the apparatus of the present specification, there can also be provided other cording machines of the same type or diverse, for paying-off the wires, or which are respectively fed by the machine of the present invention, for the purpose of forming cords with still complex formations.

What is claimed is:

1. In an apparatus for cabling metallic cords adapted for use as reinforcing elements of an elastomeric structure, said cords resulting from the union of a group of wires according to a prefixed geometrical configuration obtained and maintained through the means of appropriate deformations by bending and torsion applied to the wires, said apparatus comprising a carrier for supporting at least one pay-off bobbin for at least some of said wires, inside which the said bobbin or bobbins are freely mounted for rotation, each one around its own axis, a cage adapted for guiding the said wires along a predetermined trajectory, a frame for supporting the said cage while permitting it to rotate around its own axis, means adapted for maintaining said cage in rotation, means adapted for unwinding said wires from their respective pay-off bobbins and for drawing them through the cabling apparatus in an advancing direction, and means adapted for collecting the resulting cords, said carrier being mounted in said cage coaxially with the cage and freely rotating with respect to it, said carrier and said cage having hollow bearings whereby their terminal ends can be traversed by the wires, along a trajectory that coincides with the axis of said bearings from the interior of the carrier to the exterior of the cage and vice-versa, means being provided inside said carrier for guiding said wires according to a trajectory developed from one extremity and from said pay-off bobbins at the other extremity of the carrier, distanced from said carrier axis within the space between said extremities of the carrier—the improvement wherein inside said carrier there is provided a device for permanently deforming by bending at least part of said wires, first means for collecting at least some of the wires coming from a diverse direction and for disposing them parallel, coplanar and adjacent one of the other and for guiding them onto said device for deforming, and second means for guiding at least part of said wires along a trajectory distinct from that followed by the wires passing onto said bending device, but having in common with the latter path one point upstream said first means and another point downstream said bending device.

2. The apparatus of claim 1, wherein said bending means for permanently deforming comprises a pre-shaping pin mounted on said carrier with its axis orthogonal to the advancing direction of said wires, and parallel to those of said pay-off bobbins.

3. The apparatus of claim 2, wherein the said first means for collecting the said wires comprise a roller disposed upstream to said pre-shaping pin with respect to the direction of movement of said wires, mounted inside the carrier with its axis parallel to those of said pay-off bobbins.

4. The apparatus of claim 1, wherein said second means adapted for guiding the said wires, comprises two rollers mounted inside the carrier, at the opposite side with respect to the said pre-shaping pin and said first means, and disposed in such a way that the trajectory directly joining the said rollers does not present any point of interference with the said preshaping pin.

5. The apparatus of claim 4, wherein said two rollers are disposed in such a way that said direct trajectory is tangent to the surface of rotation of said pre-shaping pin.

* * * * *